United States Patent [19]

Wallbillich, III

[11] Patent Number: 4,815,540

[45] Date of Patent: Mar. 28, 1989

[54] METHOD AND APPARATUS FOR RELEASING A WELL PERFORATING GUN FROM A SUPPORTING TUBING STRING

[75] Inventor: Thomas J. Wallbillich, III, New Orleans, La.

[73] Assignee: Baker Hughes Incorporated, Houston, Tex.

[21] Appl. No.: 126,902

[22] Filed: Nov. 30, 1987

[51] Int. Cl.[4] ..... E21B 23/04; E21B 43/16

[52] U.S. Cl. ..... 166/377; 166/55; 166/297; 175/4.56

[58] Field of Search ..... 166/377, 297, 237, 239, 166/55; 175/4.52, 4.53, 4.54, 4.55, 4.56

[56] References Cited

U.S. PATENT DOCUMENTS

| | | | |
|---|---|---|---|
| 3,842,914 | 10/1974 | Mott | 166/377 |
| 3,997,006 | 12/1976 | Wetzel | 166/377 |
| 4,526,233 | 7/1985 | Stout | 166/297 |
| 4,540,051 | 9/1985 | Schmuck et al. | 166/297 |
| 4,541,486 | 9/1985 | Wetzel et al. | 166/297 |
| 4,557,331 | 12/1985 | Stout | 166/297 |
| 4,576,236 | 3/1986 | Stout et al. | 166/237 |
| 4,694,878 | 9/1987 | Gambertoglio | 166/377 |

*Primary Examiner*—George A. Suchfield
*Assistant Examiner*—Terry Lee Melius
*Attorney, Agent, or Firm*—Hubbard, Thurman, Turner & Tucker

[57] ABSTRACT

A perforating gun is latchably secured to the bottom end of a tubular support which in turn is connected to the bottom of a well tubing string. After the gun has been discharged, it may be released from the tubing string by dropping a ball on an upwardly facing seating surface provided on the top portions of the perforating gun assemblage and then increasing the tubing string pressure to a predetermined level which effects the release of the latching mechanism and drops the perforating gun assembly to the bottom of the well.

9 Claims, 2 Drawing Sheets

METHOD AND APPARATUS FOR RELEASING A WELL PERFORATING GUN FROM A SUPPORTING TUBING STRING

BACKGROUND OF THE INVENTION

SUMMARY OF THE PRIOR ART

The perforating of cased and uncased well bores by a perforating gun carried on the bottom of a packer, which is run into the well on a tubing string, is an expedient widely utilized in the well drilling industry. After the perforating gun is discharged, it is generally desirable to drop the perforating gun assembly from the bottom of the tubing string if the guns get stuck or access through the tubing is desired for running tools such as pressure or temperature measuring units.

The release of a perforating gun from a tubular string is disclosed in U.S. Pat. No. 2,873,675 to LeBorg. In this patent, an annular powder charge is mounted in the upper portions of the perforating gun assembly and ignited by time delay fuse so that the annular charge does not detonate until after discharge of the perforating gun. The detonation of the annular charge effects the severing of the perforating gun from the tubular string by which the gun is supported. The utilization of the time delayed explosive charge to effect the gun release is obviously unreliable. In U.S. Pat. No. 3,706,344 to VANN, it is suggested that the perforating gun be severed from the tubing string by lowering a cutting tool into the well by wireline and effecting the severing after the discharge of the perforating gun. This is obviously a time consuming operation.

In recent years, a number of issued patents have proposed that the releasing of the perforating gun assembly from its supporting tubing string or packer be accomplished in response to a differential between tubing pressure and annulus pressure. These arrangements were again found to be unreliable due to the fact that the pressure differential between the tubing string bore and the annulus above a packer carried by the tubing string and conventionally set prior to the perforating operation, is a matter of conjecture. If the formation perforated by the discharge of the perforating gun has a high formation pressure, the resulting tubing string pressure may be sharply increased, resulting in a sufficient differential between the tubing string pressure and the annulus pressure to effect the dropping of the gun, but the operator at the surface will have no knowledge of the fact and will attempt to obtain the desired pressure differential to release the gun, even though it has already been dropped.

There is a need, therefore, for a method and apparatus for severing a perforating gun assembly from a supporting tubing string or packer which may be quickly and reliably accomplished from the well surface and which will immediately provide a reliable surface indication that that gun has been released and dropped to the bottom of the well.

SUMMARY OF THE INVENTION

In accordance with the method of the invention, a tubular support member is secured to the bottom end of a tubing string, or to the bottom of a packer if a packer is employed during the well perforating operation. Such tubular support defines a collet member at its lower end having radially shiftable latching heads. On the top end of the perforating gun assembly, a pair of concentric sleeves are rigidly mounted and the collet portion of the tubular support projects into the annulus between the concentric sleeves. A downwardly facing annular surface is provided on the outer sleeve which is engagable by the latching heads of the collet when such latching heads are moved outwardly.

The annular space between the inner and outer sleeves defines a fluid pressure chamber within which an annular piston is mounted. The piston is shearably secured in an axial position where a portion of the piston engages the latching heads of the collet and hold such latching heads in engagement with the downwardly facing latching surface provided on the outer sleeve.

To prevent the inadvertent axial movement of the piston during the discharge of the perforating gun, the fluid pressure chamber regions above and below the axial ends of the annular piston are maintained in a pressure balanced condition by ports extending through the wall of the inner sleeve and thus communicating with the bore of the tubing string. Thus, tubing string pressure has no effect upon the axially shiftable piston.

To effect the release of the gun, a ball is dropped through the tubing string and comes to rest upon an upwardly facing ball seating surface provided on the inner sleeve at a position intermediate the upper and lower ports. In this position, the lower port is effectively blocked from communication with tubing string pressure. Accordingly, increasing the tubing string fluid pressure from the surface produces a pressure differential across the annular piston and shearably releases the piston for axially downward movement, thus moving the piston out of engagement with the latching heads of the collet and permitting such latching heads to be cammed inwardly and release from the downwardly facing latching surface provided on the outer sleeve by the weight of the perforating gun and the downward force imparted to the gun by the latch releasing piston movement. Thus, the entire perforating gun, plus the two sleeves, the piston and the ball are released from the tubular support and dropped to the bottom of the well. Such release is immediately indicated at the surface to the well operator by a drop in tubing pressure to zero, thus apprising the well operator that release of the perforating gun has been accomplished.

Further advantages of the invention will be readily apparent to those skilled in the art from the following detailed description, taken in conjunction with the annexed sheets of drawings, on which is shown a preferred embodiment of the invention.

DESCRIPTION OF PREFERRED EMBODIMENT

Figure 1A:
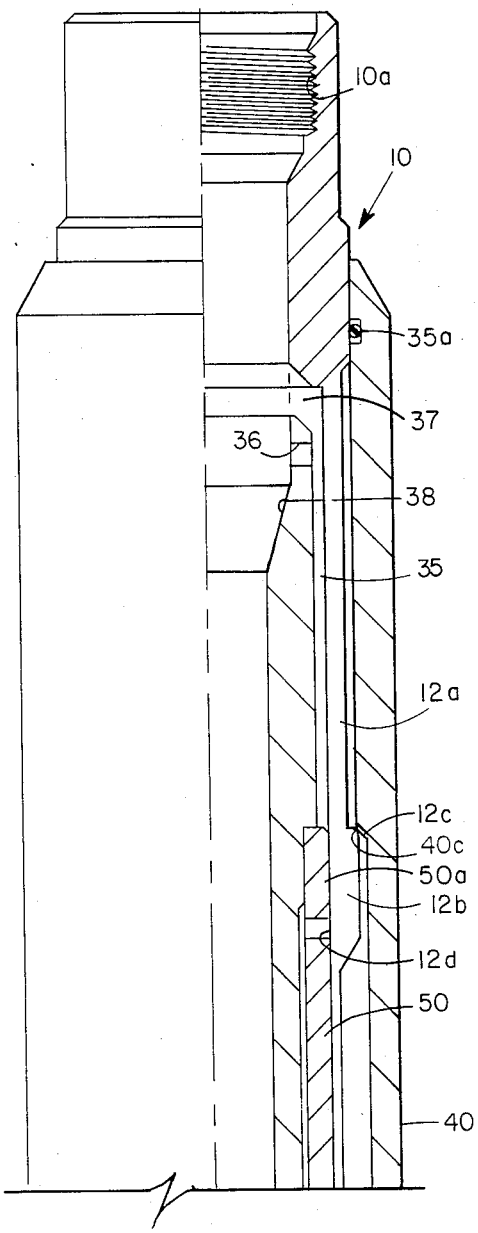
FIGS. 1A and 1B represent a vertical quarter sectional view of a releasing apparatus for a perforating gun embodying this invention. In these figures, the components of the releasing apparatus are shown in their gun securing positions.
Figure 1B:
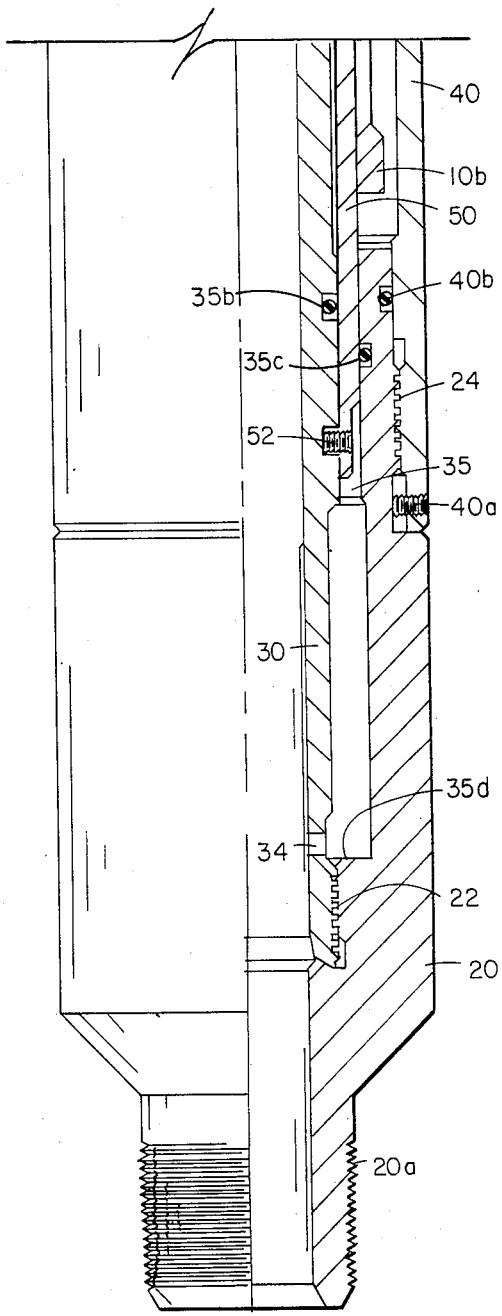

The releasing apparatus embodying this invention may be applied to the bottom end of a tubing string or, to the bottom of a packer carried by the tubing string and set in a well bore prior to the perforating operation, or to a tubing string depending from a packer. All references to "tubing string" contained in the specification and claims should therefore be interpreted as meaning any one of the above three common configurations for mounting a perforating gun within a well bore.

Referring to the drawings, a tubular support element 10 has internal threads 10*a* for sealable engagement with the bottom of a tubing string, as defined above. The lower portion of the tubular support member 10 defines an integrally formed collet 12 having peripherally spaced, depending arm portions 12*a* provided with enlarged latching head portions 12*b* near the medial portions of the collet latching arms 12*a*. The bottom end of the tubular support 10 comprises a solid ring portion 10*b*.

A connecting sub 20 is provided having external threads 20*a* on its bottom end for conventional sealed connection to the top end of a well perforating gun (not shown). The connecting sub 20 defines relatively small diameter internal threads 22 to which an internal sleeve 30 is threadably secured. Upper portion of connecting sub 20 is provided with external threads 24 to which an outer sleeve 40 is threadably secured. A set screw 40*a* and an O-ring 40*b* seals this threaded connection.

The inner and outer sleeves 30 and 40 are thus disposed in upstanding concentric relationship and the upper ends of such sleeves extend around the downwardly depending collet arms 12*a* formed on the tubular support 10. Outer sleeve 40 snugly surrounds tubular support member 10. The outer sleeve 40 is provided with a downwardly facing annular latching surface 40*c* which is engaged by the top end surface 12*c* of the collet latching heads 12*b*. When held in such engagement, it will be obvious that the outer sleeve 40, connecting sub 20 and the connected perforating gun are secured to the tubular support 10 and thereby secured to the bottom of the tubing string.

The space between the inner and outer sleeves 30 and 40 defines an annular fluid pressure chamber 35 within which is slidably and sealably mounted an annular piston 50. The annular fluid pressure chamber 35 is sealed at its upper end by an O-ring 35*a* provided in the interior surface of outer sleeve 40 and at its lower end by O-rings 35*b* and 35*c* which are respectively mounted in the outer wall of the inner sleeve 30 and the inner wall of the outer sleeve 40 and engage opposite side walls of the annular piston 50.

The piston 50 is secured in a position within the fluid pressure chamber 35 wherein the top portions 50*a* of piston 50 are in engagement with the inner surfaces of the latching heads 12*b* and hold such latching heads securely in engagement with the downwardly facing surface 40*c*. Piston 50 is secured in such position by a shear pin 52 which engages an annular recess on the exterior of the inner sleeve 30.

To prevent the annular piston 50 from shifting from this latch securing position, a fluid pressure balance is provided across the top and bottom ends of annular piston 50 by a lower port 34 and an upper port 36 respectively formed in the walls of the inner sleeve 30. Port 36 supplements a gap 37 normally provided above the top end of inner sleeve 30. Thus, any increase in tubing pressure during or after the firing of the perforating gun will have no effect on the annular piston 50. Nor is the annular piston 50 in any manner affected by the annulus pressure existing around the coupling apparatus or above the packer, if one is utilized.

Figure 2A:
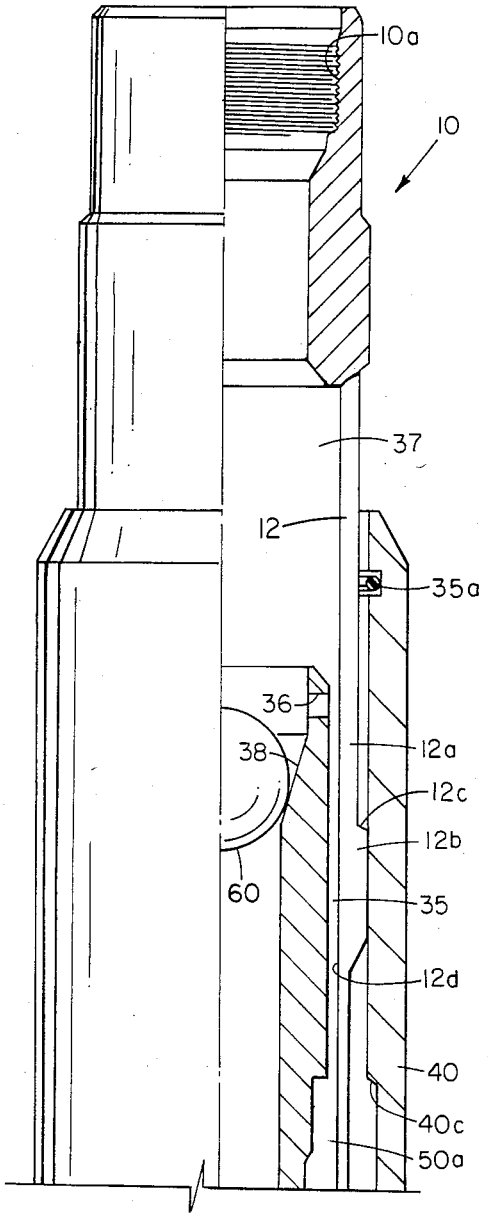
FIGS. 2A and 2B are views respectively similar to FIGS. 1A and 1B but showing the position of the components of the releasing apparatus immediately after the release of the perforating gun has been accomplished.

To effect the disengagement of the coupling apparatus in accordance with this invention, the inner sleeve 30 is provided on its inner surface, at a point intermediate the radial ports 34 and 36 with an upwardly facing ball seating surface 38. When a ball 60 (FIG. 2A) is dropped through the tubing string after the perforating gun has been discharged, such ball will seat and seal on the ball seating surface 38 and thus effectively block the lower radial port 34 from communication with the fluid pressure existing in the tubing string. Hence, an increase in fluid pressure in the tubing string produced from the surface will increase the fluid pressure above the annular piston 50 relative to the fluid pressure existing below the annular piston 50. When this fluid pressure is increased to a level sufficient to effect the shearing of shear pin 52, the piston 50 moves downwardly, thus removing its upper portions 50*a* from engagement with the collet surface 12*d* and permitting the latching heads 12*b* of the collet 12 to be deflected inwardly.

Figure 2B:
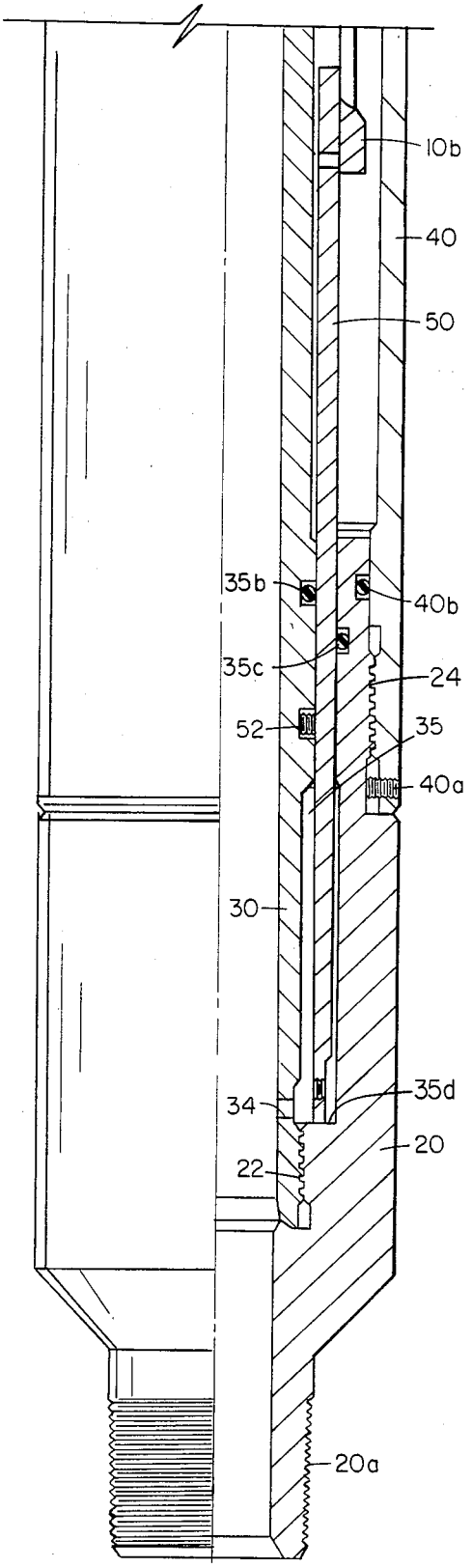

It should be noted that if the weight of the perforating gun is not sufficient to effect such deflection of the collet latching heads 12*b*, the downward movement of the piston 50 will result in such piston striking the upwardly facing bottom surface 35*d* of the fluid pressure chamber 35 and will produce a downward force on the entire coupling apparatus sufficient to effect the disengagement of the collet latching heads 12*b* from the annular latching surface 40*c*. Accordingly, as soon as the collet heads 12*b* are freed from the latching surface 40*c*, the perforating gun, plus the connecting sub 20, the inner and outer sleeves 30 and 40, the piston 50, and the ball 60 are free to fall to the bottom of the well, as illustrated in FIG. 2B.

From the foregoing description, it will be readily apparent to those skilled in the art that this invention provides a method and apparatus for effecting the release of a perforating gun assembly from a tubing string in an efficient and reliable manner The release mechanism is completely isolated from any effects due to unusual tubing pressures or annulus pressures, and the separation cannot be achieved until after the ball 60 is dropped in sealing engagement with the ball seating surface 38 and the tubing string pressure increased from the surface to a preselected level sufficient to effect the shearing of the piston shear pin 52.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. The method of supporting and releasing a perforating gun from the bottom of a tubular support run into a subterranean well by a tubing string, comprising the steps of:

(1) providing a collect on the bottom of the tubular support, said collet having a plurality of radially shiftable latching heads;

(2) mounting a pair of sleeves on the perforating gun in upstanding, concentric relation; one of said sleeves defining a downwardly facing annular surface engagable with the latching heads; said sleeves defining an annular fluid pressure chamber therebetween having an upwardly facing surface in the lower portions of the chamber;

(3) inserting a downwardly shiftable annular piston in sealable relationship in said annular fluid pressure chamber and above said upwardly facing surface;

(4) shearably securing said annular piston to one of said sleeves in a position holding said collet latching heads in engagement with said downwardly facing annular surface, thereby securing the perforating gun to the tubing string for run-in and discharge purposes;

(5) creating a fluid pressure in said annular fluid pressure chamber supplied from the tubing string, thereby shearably releasing said piston to move out of engagement with said collet locking heads, whereby said collet locking heads shift radially to clear said downwardly facing annular surface and release said perforating gun and said pair of sleeves to fall to the well bottom; and (6) continuing the application of fluid pressure to said piston to engage said position with said upwardly facing surface to said in the release of said perforating gun.

2. The method of claim 1 wherein the innermost sleeve is provided with a ball seat; and the step of creating a fluid pressure comprises dropping a ball through the tubing string to seat on said ball seat to permit increasing the fluid pressure in the tubing string from the well surface.

3. The method of supporting and releasing a perforating gun from the bottom of a tubular support run into a subterranean well by a tubing string, comprising the steps of:

(1) providing a collet on the bottom of the tubular support, said collet having a plurality of radially shiftable latching heads;

(2) securing said latching heads in engagement with a latching surface on the perforating gun by a downwardly shiftable piston;

(3) maintaining balanced pressures above and below said piston during discharge of the perforating gun by axially spaced ports communicating with the bore of the tubing string;

(4) blocking the lowermost port; and (5) increasing the fluid pressure in the tubing string to produce an unbalanced fluid pressure on said piston to shift said piston downwardly to first release said latching heads from said latching surface solely in response to said increased fluid pressure in the tubing string and secondly, to engage and move the perforating gun downwardly.

4. The method of claim 3 further comprising providing a ball seating surface above the lowermost port and dropping a ball on said ball seating surface to permit increasing the fluid pressure in the tubing string.

5. Apparatus for supporting and releasing a perforating gun in a subterranean well, comprising, in combination, a tubular support element rigidly attachable to the bottom of a tubing string; a pair of upstanding concentric sleeves rigidly attachable to the top of a perforating gun and defining an annular chamber having an upwardly facing surface in its lower portion; one of said sleeves defining a downwardly facing locking surface above said upwardly facing surface; latching means secured to said tubular support element and having radially shiftable locking heads engagable with said downwardly facing locking surface; a downwardly annular piston sealably mounted between said sleeves and cooperating therewith to define a fluid pressure chamber; means for shearably securing said annular piston in an axial position where said annular piston holds said locking heads in engagement with said downwardly facing locking surface; and means for supplying fluid pressure through the tubing string to said annular piston to shift said annular piston downwardly to first release said locking heads from said downwardly facing locking surface to release said pair of sleeves and the perforating gun from the tubing string and secondly, to engage said upwardly facing surface to downwardly displace said perforating gun.

6. The apparatus of claim 5 wherein said locking means comprises a collet integrally formed on said tubular support.

7. Apparatus for supporting and releasing a perforating gun in a subterranean well, comprising, in combination, a tubular support element rigidly attachable to the bottom of a tubing string; a pair of upstanding concentric sleeves rigidly attachable to the top of a perforating gun; one of said sleeves defining a downwardly facing locking surface; latching means secured to said tubular support element and having radially shiftable locking heads engagable with said downwardly facing locking surface; a downwardly shiftable annular piston sealably mounted between said sleeves and cooperating therewith to define a fluid pressure chamber; means for shearably securing said annular piston in an axial position where said annular piston holds said locking heads in engagement with said downwardly facing locking surface; axially spaced radial port means in the inner one of said sleeves providing balanced tubing string fluid pressure above and below said annular piston; and means for blocking fluid communication between the lower one of said ports and the tubing string bore, whereby a predetermined increase in tubing pressure will shearably release said piston for downward movement to release said pair of sleeves, and the perforating gun from the tubing string and means between said sleeves engagable by further downward movement of said piston to urge said perforating gun downwardly.

8. The apparatus of claim 7 wherein said locking means comprises a collet integrally formed on said lower portions of said tubular support.

9. The apparatus of claim 7 wherein said means for blocking fluid communication comprises a ball seating surface located between said radial port means and a ball droppable through the tubing string to seat on said ball seat.

* * * * *